United States Patent [19]

Kryczun et al.

[11] Patent Number: 4,465,265

[45] Date of Patent: Aug. 14, 1984

[54] LANCE FOR BLOW TYPE REACTOR

[75] Inventors: Alfred Kryczun; Rolf Pufal, both of Cologne, Fed. Rep. of Germany

[73] Assignee: Klöckner-Humboldt-Deutz AG, Fed. Rep. of Germany

[21] Appl. No.: 510,322

[22] Filed: Jul. 1, 1983

[30] Foreign Application Priority Data

Jul. 9, 1982 [DE] Fed. Rep. of Germany ..... 3225772

[51] Int. Cl.[3] ..... C21C 5/32

[52] U.S. Cl. ..... 266/226; 266/270

[58] Field of Search ..... 266/226, 265, 270; 254/7 R, 7 C, 7 B, 98

[56] References Cited

U.S. PATENT DOCUMENTS

| | | | |
|---|---|---|---|
| 1,333,254 | 3/1920 | Hutchinson | 254/98 |
| 2,004,060 | 6/1935 | Brown | 254/98 |
| 2,742,257 | 4/1956 | Hott et al. | 254/7 B |
| 3,096,173 | 7/1963 | Kennedy | 266/226 |
| 3,180,503 | 4/1965 | Shaw | 254/7 C |
| 3,215,402 | 11/1965 | Hott et al. | 254/7 B |
| 3,216,713 | 11/1965 | Imaida et al. | 266/226 |
| 3,391,905 | 7/1968 | Burns | 254/7 B |
| 3,669,437 | 6/1972 | Wernicke | 266/226 |
| 3,685,796 | 8/1972 | Eggert, Jr. | 254/7 R |

FOREIGN PATENT DOCUMENTS

| | | | |
|---|---|---|---|
| 2098781 | 3/1972 | France | 266/226 |
| 319766 | 6/1972 | U.S.S.R. | 266/226 |

*Primary Examiner*—L. Dewayne Rutledge
*Assistant Examiner*—Robert L. McDowell
*Attorney, Agent, or Firm*—Hill, Van Santen, Steadman & Simpson

[57] ABSTRACT

The present invention deals with a blow lance which projects into a reactor to an adjustable vertical extent. The lance structure includes a tubular lance member and a bellows surrounding the tubular lance and being expansible in the axial direction, the bellows having its lower end coupled to a lower portion of the lance and its upper end received about an upper portion of the tubular lance. The preferred structure includes a protective sleeve which surrounds a lower portion of the lance and extends into the opening of the reactor, with means being provided for circulating a coolant therethrough.

6 Claims, 1 Drawing Figure

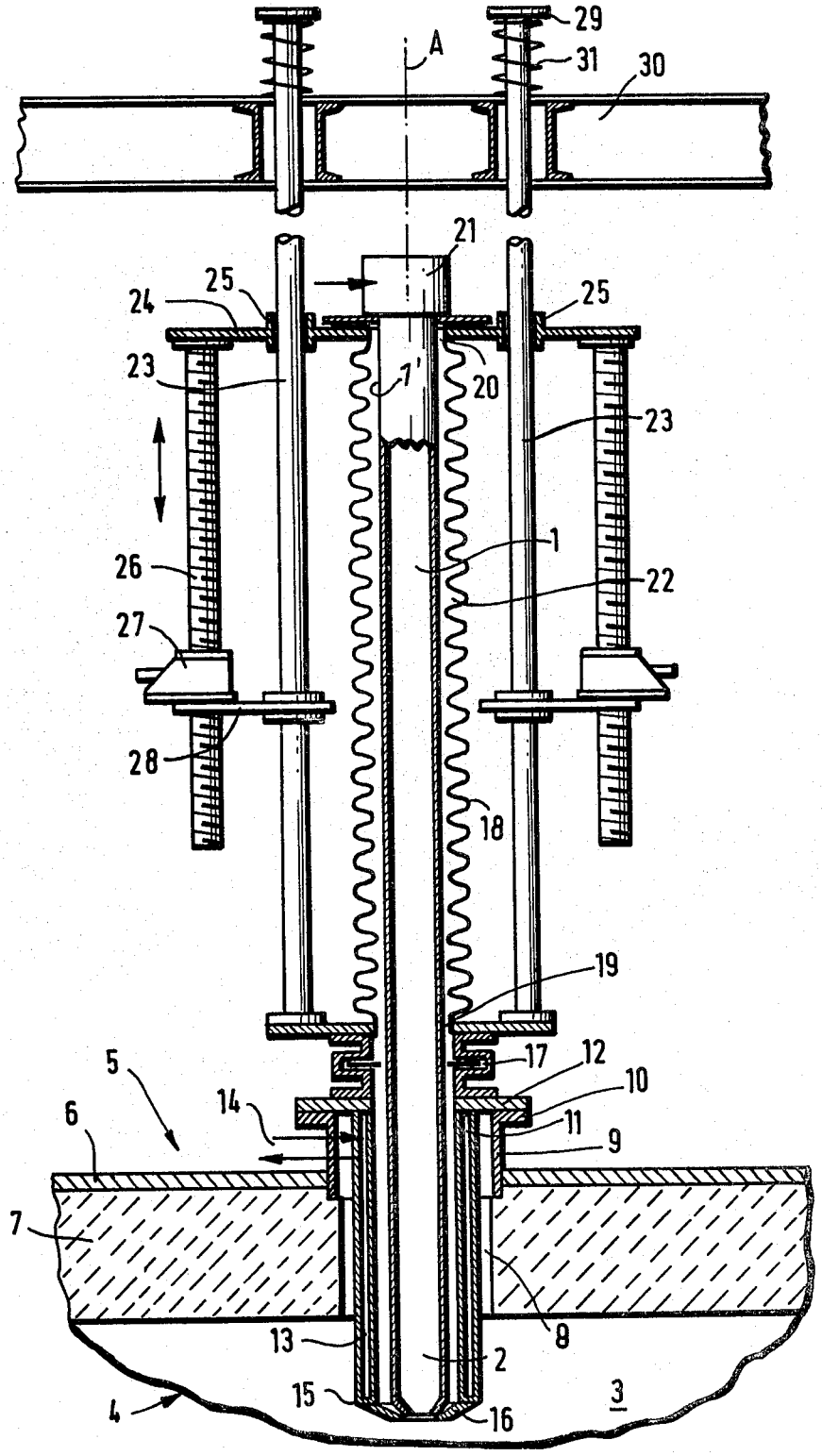
29
31
30
A
21
25
24
25
23
7'
20
23
1
26
22
27
28
18
19
17
12
10
5
14
11
6
9
7
8
13
2
15
16
3
4

LANCE FOR BLOW TYPE REACTOR

BACKGROUND OF THE INVENTION

1. Field of the Invention

This invention is in the field of reactor structures which use one or more lances to blow a reaction gas onto the surface of molten metal within a reactor for various purposes such as generating a synthesis gas or refining the metal.

2. Description of the Prior Art

A disclosure for decarburizing an iron or steel melt wherein oxygen is blown onto the surface of the melt through a vertically adjustable blow lance is described in German As No. 19 04 442. In order to provide for gas-tight sealing, a packing box is provided for the adjustably positionable blow lance.

With a metallurgical process which involves blowing an oxygen stream from above onto a metal melt, it is unavoidable that the molten bath becomes extremely agitated and spatters as a result of the gas jet penetrating into the melt and also as a result of the generation of reaction gas arising during refining. In addition to spatters, metal and dust particles are also entrained with the evolving gas and proceed into the gas space. Deposits and incrustations are thereby formed on the shaft of the lance, damaging the packing of the packing box so that axial movements of the lance result in a loss of tightness and even to a termination of operation.

The sealing of a variable height blow lance in the cover of a metallurgical reactor through a packing box, moreover, is also full of problems and susceptible to disruption because the seal is only effective when the axis of the blow lance and of the packing box coincide exactly. This requires a very precise guidance of the blow lance which can be realized only with great difficulty in view of the length and weight of the lance itself.

SUMMARY OF THE INVENTION

The present invention provides an adjustably positionable lance which has a gas-tight fitting permitting the lance to be moved vertically with respect to the contents of the reactor, and without problems presented by the pressure differential to the ambient atmosphere in the reactor. In particular, the blow lance of the present invention provides a high degree of accessibility immediately above the highly spattering metal bath and under conditions of high gas evolution and high temperature conditions. If necessary, the blow lance of the present invention can be replaced without the necessity of an interruption in operation.

The blow lance structure of the present invention provides a gas-tight passage comprising a metal bellows which is expandable in its axial direction, having its lower end coupled to the lower portion of the lance and its upper end received about an upper portion of the lance. There is thus provided a space between the lance and the metal bellows which is in fluid communication with the gas space of the reactor. As a result, the opening in the cover to which the metal bellows is connected in pressure-tight relationship at its lower end can have a diameter greater than the diameter of the lance by an annular gap. Consequently, the axial mobility of the bellows is retained even under high wear and contamination conditions. An unimpeded mobility or height adjustability of the blow lance is thereby maintained problem-free even when under conditions of high spattering and other difficult operating conditions.

In a preferred form of the invention, the blow lance is surrounded at least in part by a protective sleeve which projects into the reactor through the same opening as the lance. This protective sleeve may have a double walled structure with provisions therein for introducing and withdrawing a coolant. With this type of protective sleeve, particularly where a circulating coolant is involved, deposits and incrustations are kept away from the blow lance to the greatest possible degree. The cooled protective sleeve also reduces heat radiation from the metal bath to the lance. This provides the further advantage that a lance need not be provided with a cooling water jacket in many cases. Accordingly, the lance can be designed of lighter weight, more readily movable, and less expensively, for example, as a single walled pipe. Consequently, savings in weight and manufacturing costs for the lance and the guidance system are obtained, and the mobility of the lance is improved.

In a preferred form of the present invention there is provided a cut-off device for blocking the opening of the reactor when the lance structure is raised to its elevated position. This cut-off means can be an armature actuatable by an electric motor or can be actuated pneumatically as through a slide or a ball cock and serves the purpose of closing the reactor off relative to the outside atmosphere after the lance has been elevated.

A substantial advantage resulting from this arrangement is an interchangeability of the lance without the necessity for interrupting the operation of the reactor if a plurality of lances is provided. The blocking cut-off thus enables a lance replacement during an uninterrupted blowing process in a problem-free, advantageous manner. This is of substantial importance where a reactor is used for fuel gasification because each such operating interruption provides considerable problems, as understood by those skilled in the art.

The guide means for guiding the vertical movement of the lance preferably consists of two guide rods, one on each side of the lance, and a plate through which the guide rods extend in sliding relation, the plate being secured to the head of the lance. This type of guide system is uncomplicated, suitable for very rugged operation, and can be produced of readily available material with low manufacturing cost.

For raising and lowering the lance, there is provided at least one lifter element consisting preferably of a screw drive which is disposed parallel to the axis of the guide rods. The lower ends of the lifter elements are connected to the guide rods and the upper ends are connected to the aforementioned plate. The upper ends of the guide rods can extend up into a supporting structure which may also contain a pair of springs tending to bias the rods away from the supporting structure.

The advantage of this type of design is that a loading of the cover and/or wall of the reactor is avoided. Further, the guide rods form a functional unit together with the lifter elements including the blow lance and the expandable metal bellows guided by the lifter elements. This arrangement is one which is adapted to rugged operation and is suitable for connection to a remote control particularly since it requires no maintenance under normal operating conditions because of its reliability. When the guide rods are suitably suspended, they can be made relatively light with a relatively small diameter even they are of greater length since they are essentially stressed in tension and not subject to buckling stresses.

BRIEF DESCRIPTION OF THE DRAWING

The single FIGURE in the drawing is a fragmentary view, partly in elevation and partly in cross section, of a sample embodiment of the present invention.

DESCRIPTION OF THE PREFERRED EMBODIMENTS

The invention, together with its advantages, is described in greater detail with reference to a sample embodiment shown in the drawing.

The Figure of the drawing shows a lance 1 having a discharge end 2 projecting into a gas space 3 of a reactor 4. An upper wall 5 of the reactor 4 consists of an outer jacket of sheet steel 6 which is provided with a fireproof lining 7 at its underside. An opening 8 for the lance 1 is provided in the wall 5. A connector 9 having a flange 10 welded to the outer jacket 6 forms the outer terminus of the opening 8.

A protective sleeve 11 is disposed concentrically with the opening 8. The sleeve 11 is equipped with a flange 12 which is rigidly connected to the flange 10 of the connector 9. The protective sleeve 11 is designed as a double-walled structure and is equipped with channels 13 for circulation of a coolant. The intake and discharge of the coolant is shown schematically by means of the arrows 14.

The protective sleeve 11 is concentric with and surrounds the lance 1 and is slightly spaced therefrom. It protects the lance 1 against the influence of heat, against deposits of dust and also against caking of slag and metal spatters. It accordingly guarantees problem-free introduction and removal of the lance 1. It may also be provided with a stop 16 in the vicinity of its lower orifice 15 thus providing further protection of the orifice area 2. The precise distance of the lance mouth 2 from the bath surface is also fixed by means of the stop 16. Necessary changes in the lance spacing from the bath surface can thereby be undertaken, for example, by means of inserting longer or shorter protective sleeves 11. If necessary, the protective sleeve can also be made variable in height.

A cut-off means consisting of a pressure-proof and heat-proof armature 17 which may, if necessary, be water-cooled, is disposed above the opening 8 or above the protective sleeve 11. This armature 17 can be actuated with an electric motor or it can be operated pneumatically as, for example, in the case of a slide or a ball cock. In the case of a gasification reactor operating with excess pressure, for example, the shut-off armature 17 represents a feature which is essential to the operation of the invention.

Despite the proved shielding provided by the protective sleeve 11, the blow lance 1 must be periodically checked and, if necessary, be subjected to an inspection and/or replacement of the mouth of its nozzle. This can be accomplished by means of the shut-off armature 17 without interrupting operations. The lance 1 is first raised until its mouth area 2 is situated above the shut-off armature 17. Then the armature 17 is subsequently closed and the lance 1 is removed from its guide system.

One of the most important features of the present invention is the provision of a seal for the lance 1 relative to the opening 8, including a metal bellows 18 expansible in the axial direction. The bellows 18 has one end portion 19 which is connected rigidly and pressure-tight in its lower area to the shut-off armature 17 and which in its upper end portion 20 surrounds the shaft 1' or the head of the lance 21 in pressure-tight relationship. By so doing, a gas space 22 is formed between the metal bellows 18 and the lance 1, the gas space 22 being in fluid communication through the connector 9 with the gas space 3 of the reactor 4. A problem-free mobility for the lance 1 in the area of the opening 8 is thereby provided while avoiding the use of a packing box. Slight deviations of the axis "A" of the lance 1 from axial alignment with the connector 9 are thereby insignificant because they produce no impediments regarding the mobility of the lance and/or the effectiveness of the seal. This likewise applies in the case of deposits and/or incrustations due to slag or metal spatters.

The guide system includes a pair of guide rods 23, one on each side of the tubular lance 1. These guide rods can be designed for rugged use without the necessity of precise tolerances being observed. At the head portion 21 of the lance structure, there is provided a guide and drive plate 24 through which the guide rods 23 are received in sliding relation by means of guide bushings 25. Drive elements for moving the lance 1 up and down are provided on both sides of the guide rods 23. In the embodiment illustrated in the invention, these consist of a screw drive assembly including a lifting spindle 26 and a motor-driven spindle nut 27. These elements are supported against the guide rod 23 by means of sole plates 28. Other drives, for example, consisting of hydraulic piston and cylinder units can also be employed instead of the lifter spindles 26 and the spindle nuts 27.

Each guide rod at its upper end 29 is suspended in a support structure 30 and is biased therefrom by means of relief springs 31. With this type of support structure, the weight of the overall lifting and guide means as well as of the lance is absorbed by the support structure 30 to thereby take the weight off the shut-off armature 17 as well as the connector 9. The springs 31 also provide a very advantageous compensation of expansion which can be produced, for example, due to heater stresses. The lance 1 may be further protected by injecting a protective gas in the space 22 between the lance and the metal bellows 18.

After closing the shut-off armature 17 and relieving the pressure of the space 22, the replacement of the lance 1 is accomplished by undoing and removing the lance 1 toward the top through the guide and drive plate 24 or by means of disassembling the overall arrangement above the shut-off armature 17.

Instead of using a metal bellows to secure the gas-tight lance arrangement, a cladding of the lance 1 or of the lance shaft 1' with telescoping tubes or sliding seals might also be used above the shut-off armature under certain conditions. This type of solution, however, would probably result in higher production costs, operating expenses, and maintenance expenses than the use of the metal bellows 18.

It should be evident that various modifications can be made to the described embodiments without departing from the scope of the present invention.

We claim as our invention:

1. A blow lance arranged to be positioned at an adjustable height through an opening in a reactor comprising:

a tubular lance, a protective sleeve surrounding a lower portion of said lance and proportioned to extend through said opening and project into said reactor, fluid circulating means in said protective sleeve, means for introducing a coolant into said fluid circulating means, and a bellows surrounding said tubular lance and being expansible in the axial direction, said bellows having its lower end coupled to a lower portion of said lance and its upper end received about an upper portion of said tubular lance.

2. A reactor structure comprising:

an upper wall having an opening therein, a tubular lance projecting through said opening, a protective sleeve fitting into said opening and surrounding a portion of the tubular lance projecting into said reactor, means for circulating a coolant through said protective sleeve, a bellows surrounding said tubular lance and being expansible in its axial direction, and means for expanding and contracting said bellows to vary the position of said tubular lance relative to said reactor.

3. A reactor structure according to claim 2 which includes:

cut-off means for blocking said opening when said tubular lance is in an elevated position withdrawn from said opening.

4. A reactor structure according to claim 2 which includes:

a pair of guide rods one on each side of said tubular lance, a plate rigidly connected to the upper end portion of said tubular lance, and bushing means permitting relative sliding movement between said plate and said guide rods.

5. A reactor structure according to claim 4 which includes:

a pair of drive screws disposed parallel to the axes of said guide rods, means coupling each drive screw to one of said guide rods and means securing the upper end of each drive screw to said plate.

6. A reactor structure according to claim 4 which includes:

a support structure located above said drive screws and receiving the upper ends of said guide rods therethrough, and spring means biasing said upper ends away from said support structure.

* * * * *